US010683709B2

(12) United States Patent
Veit et al.

(10) Patent No.: US 10,683,709 B2
(45) Date of Patent: Jun. 16, 2020

(54) SHUNT SYSTEM WITH SHROUD SECURED BY A LOCKING MEMBER

(71) Applicant: HALLIBURTON ENERGY SERVICES, INC., Houston, TX (US)

(72) Inventors: Jan Veit, Plano, TX (US); Matthew Ryan Gommel, The Colony, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 244 days.

(21) Appl. No.: 15/541,945

(22) PCT Filed: Mar. 6, 2015

(86) PCT No.: PCT/US2015/019243
§ 371 (c)(1),
(2) Date: Jul. 6, 2017

(87) PCT Pub. No.: WO2016/144301
PCT Pub. Date: Sep. 15, 2016

(65) Prior Publication Data

US 2018/0002989 A1 Jan. 4, 2018

(51) Int. Cl.
*E21B 17/046* (2006.01)
*E21B 43/04* (2006.01)
(Continued)

(52) U.S. Cl.
CPC ..... *E21B 17/046* (2013.01); *E21B 17/18* (2013.01); *E21B 19/16* (2013.01); *E21B 43/04* (2013.01);
(Continued)

(58) Field of Classification Search
CPC ..... E21B 43/04; E21B 43/045; E21B 43/08; E21B 17/02; E21B 17/18; E21B 19/16; E21B 23/02
See application file for complete search history.

(56) References Cited

U.S. PATENT DOCUMENTS 5,044,438 A * 9/1991 Young ..... E21B 17/1007 166/382
9,562,402 B2 * 2/2017 Vu ..... E21B 43/08
(Continued)

OTHER PUBLICATIONS

International Search Report and Written Opinion for International Application No. PCT/US2015/019243 dated Oct. 29, 2015.
(Continued)

*Primary Examiner* — Taras P Bemko
*Assistant Examiner* — Dany E Akakpo
(74) *Attorney, Agent, or Firm* — Haynes and Boone, LLP

(57) ABSTRACT

An assembly adapted to be disposed within an oil or gas wellbore and including first and second completion joints, each including a base pipe, a shunt tube disposed along the base pipe, and a tubular outer shroud disposed about respective portions of the shunt tube and the base pipe; a jumper tube coupling the shunt tube of the first completion joint to the shunt tube of the second completion joint; and a tubular sliding shroud disposed about at least one of the first and second completion joints and adapted to slide longitudinally to a run-in position, in which the tubular sliding shroud is disposed about the jumper tube and respective portions of the first and second completion joints, thereby covering the jumper tube. A method and apparatus are also provided.

20 Claims, 16 Drawing Sheets

(51) Int. Cl.

| | |
|---|---|
| ***E21B 17/18*** | (2006.01) |
| ***E21B 19/16*** | (2006.01) |
| ***E21B 43/08*** | (2006.01) |
| ***E21B 43/267*** | (2006.01) |
| ***E21B 43/10*** | (2006.01) |

(52) U.S. Cl.
CPC ..... *E21B 43/108* (2013.01); *E21B 43/045* (2013.01); *E21B 43/267* (2013.01)

(56) References Cited

U.S. PATENT DOCUMENTS

| | | | | |
|---|---|---|---|---|
| 2010/0059232 | A1 | 3/2010 | Langlais et al. | |
| 2012/0298376 | A1 | 11/2012 | Twardowski | |
| 2013/0220635 | A1 | 8/2013 | Greci et al. | |
| 2013/0327542 | A1* | 12/2013 | Least ..... | E21B 43/04 166/380 |
| 2014/0231097 | A1 | 8/2014 | Veit | |
| 2014/0262332 | A1 | 9/2014 | McNamee et al. | |

OTHER PUBLICATIONS

Examination Report No. 1 for Australian Application No. 2015385837 issued by IP Australia dated Feb. 14, 2018, 3 pages Feb. 14, 2018.
Re-examination report issued by the Australian Patent Office for Patent No. 2015385837 dated Jan. 10, 2020, 4 pages.

* cited by examiner

SHUNT SYSTEM WITH SHROUD SECURED BY A LOCKING MEMBER

TECHNICAL FIELD

The present disclosure relates generally to well completion and production operations and, more specifically, to facilitating the making-up of a completion joint on an oil or gas platform by utilizing a shunt system with a shroud secured by a locking member.

BACKGROUND

In the process of completing an oil or gas well, a tubular is run down-hole and used to communicate fluids between the surface and the formation. During production, a well-screen assembly may be utilized to control and limit debris such as gravel, sand, or other particulates from entering the tubular and being communicated to the surface. The well-screen assembly is coupled to the tubular and includes several completion joints connected in series with one another. A gravel-packing operation may be utilized to form the filter around the well-screen assembly within the wellbore. During the gravel-packing operation, a slurry containing a particulate material is communicated from the surface to the wellbore. The particulate material is packed around the well-screen assembly to form a permeable mass, through which fluid is permitted to flow. Shunt tubes may be disposed longitudinally along the completion joints of the well-screen assembly to provide an alternate flow path for the slurry during the gravel-packing operation. The shunt tubes are in communication with the wellbore and operate to reduce sand-bridging during the gravel-packing operation, i.e., blockages formed in the wellbore by accumulated particulate material, which could inhibit the flow of the slurry around the well-screen assembly. The shunt tubes are susceptible to damage when the tubular and well-screen are run down-hole from the surface. However, a significant amount of time and tools are needed to install components capable of adequately protecting the shunt tubes before the completion joints are run down-hole. Therefore, what is needed is a system, assembly, method, or apparatus that addresses one or more of these issues, and/or other issues.

BRIEF DESCRIPTION OF THE DRAWINGS

Various embodiments of the present disclosure will be understood more fully from the detailed description given below and from the accompanying drawings. In the drawings, like reference numbers may indicate identical or functionally similar elements.

DETAILED DESCRIPTION

Figure 1:
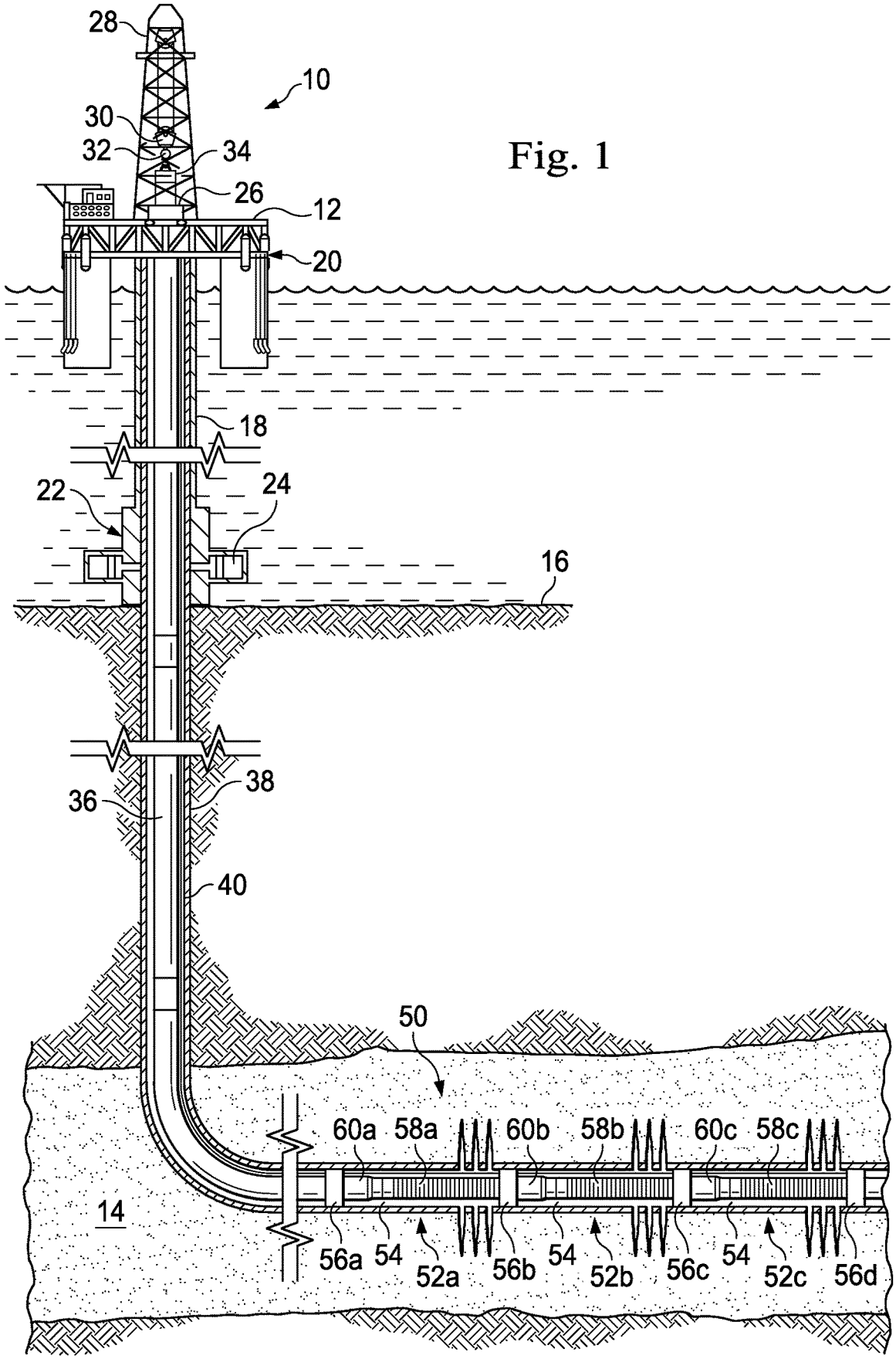
FIG. 1 is a schematic illustration of an offshore oil and gas platform operably coupled to a lower completion string disposed within a wellbore, the lower completion string including a well-screen assembly, according to an exemplary embodiment.

Illustrative embodiments and related methods of the present disclosure are described below as they might be employed in a shunt system with a connection shroud secured by a centralizer. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The following disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "up-hole," "down-hole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" may encompass both an orientation of above and below. The apparatus may be otherwise oriented (rotated 90 degrees or at other orientations) and the spatially relative descriptors used herein may likewise be interpreted accordingly.

In an exemplary embodiment, as illustrated in FIG. 1, a lower completion string is installed in a well from an offshore oil or gas platform that is schematically illustrated and generally designated 10. A semi-submersible platform 12 is positioned over a submerged oil and gas formation 14 located below a sea floor 16. A subsea conduit 18 extends from a deck 20 of the platform 12 to a subsea wellhead installation 22, which includes blowout preventers 24. The platform 12 has a hoisting apparatus 26, a derrick 28, a travel block 30, a hook 32, and a swivel 34 for raising and lowering pipe strings, such as a substantially tubular, axially extending tubing string 36.

A wellbore 38 extends through the various earth strata including the formation 14 and has a casing string 40 cemented therein. A generally tubular lower completion string 50 is connected to, and/or is part of, the tubing string 36. The lower completion string 50 is disposed in a substantially horizontal portion of the wellbore 38 and includes one or more completion sections 52 such as, for example, completion sections 52*a-c*. Completion sections 52*a-c* correspond to different zones of the formation 14. An annulus 54 is defined between the lower completion string 50 and the casing string 40. Isolation packers 56, such as, for example, isolation packers 56*a-d*, each form a seal preventing annular flow within the annulus 54 and fluidically isolating each of the completion sections 52*a-c*. In an exemplary embodiment, one or more of the isolation packers 56*a-d* are hydraulic set packers. In several exemplary embodiments, one or more of the isolation packers 56*a-d* are other types of packers that are not hydraulic set packers, such as, for example, mechanical set packers, tension set packers, rotation set packers, inflatable packers, another type of packer capable of sealing the annulus 54, or any combination thereof. Each completion section 52*a-c* includes a respective well-screen assembly 58*a-c* and a respective packing valve 60*a-c*. Several intervals of the casing string 40 are perforated adjacent the well-screen assemblies 58*a-c*.

Generally, with continuing reference to FIG. 1, the operation of the lower completion string 50 includes communicating a slurry (not shown), made up of a carrier fluid and a particulate material, within a work string (not shown) from the surface to the completion sections 52*a-c*. The packing valves 60*a-c* correspond to the completion sections 52*a-c*, respectively, and direct the slurry into the annulus 54. The slurry flows through the perforations in the casing string 40 into the formation 14 and/or through the well-screen assembly 58 and back up the work string (not shown) to the surface. In an exemplary embodiment, a fracturing operation is performed wherein the carrier fluid transports the particulate material (in this case, proppant) into the formation 14, thereby propping open induced fractures in the formation 14. In another exemplary embodiment, a gravel-packing operation is performed wherein the particulate material (in this case, gravel) is packed around the well-screen assembly 58 to form a gravel-pack filter, i.e., a permeable mass of gravel through which fluid is allowed to flow that prevents, or at least reduces, the flow of debris from the formation 14 into the well-screen assembly 58. During production, the well-screen assemblies 58*a-c* and the gravel-pack filters, in combination, control and limit debris such as gravel, sand, or other particulates from entering the lower completion string 50 and being communicated to the surface. The well-screen assembly 58 includes a shunt system (not visible in FIG. 1) disposed longitudinally therealong. The shunt system provides an alternate flow path for the slurry during the gravel-packing operation, thereby preventing sand-bridging, i.e., blockages formed in the annulus 54 by accumulated gravel and/or other accumulated particulates. Such blockages might otherwise inhibit the flow of the slurry along the well-screen assembly 58 during the gravel-packing operation.

Although FIG. 1 depicts a horizontal wellbore, it should be understood by those skilled in the art that the exemplary embodiments of the present disclosure are equally well suited for use in wellbores having other orientations including vertical wellbores, slanted wellbores, multilateral wellbores or the like. Accordingly, it should be understood by those skilled in the art that the use of directional terms such as "above," "below," "upper," "lower," "upward," "downward," "up-hole," "down-hole" and the like are used in relation to the illustrative embodiments as they are depicted in the figures, the upward direction being toward the top of the corresponding figure and the downward direction being toward the bottom of the corresponding figure, the up-hole direction being toward the surface of the well, the down-hole direction being toward the toe of the well. Also, even though FIG. 1 depicts an offshore operation, it should be understood by those skilled in the art that the exemplary embodiments of the present disclosure are equally well suited for use in onshore operations. Further, even though FIG. 1 depicts a cased hole completion, it should be understood that the exemplary embodiments of the present disclosure are equally well suited for use in open hole completions.

As indicated above, each completion section 52*a-c* includes respective ones of the isolation packers 56*a-c*, the well-screen assemblies 58*a-c*, and the packing valves 60*a-c*. The completion sections 52*a-c* are substantially identical to one another. Therefore, in connection with FIGS. 2, 3A-3D, 4, 5, 6, 7A-7D, 8, 9A, and 9B, only one of the completion sections 52*a-c* will be described in detail below using the foregoing reference numerals, but the suffixes a-c will be omitted to indicate that the description below applies to any one of the completion sections 52*a-c*.

Figure 2:
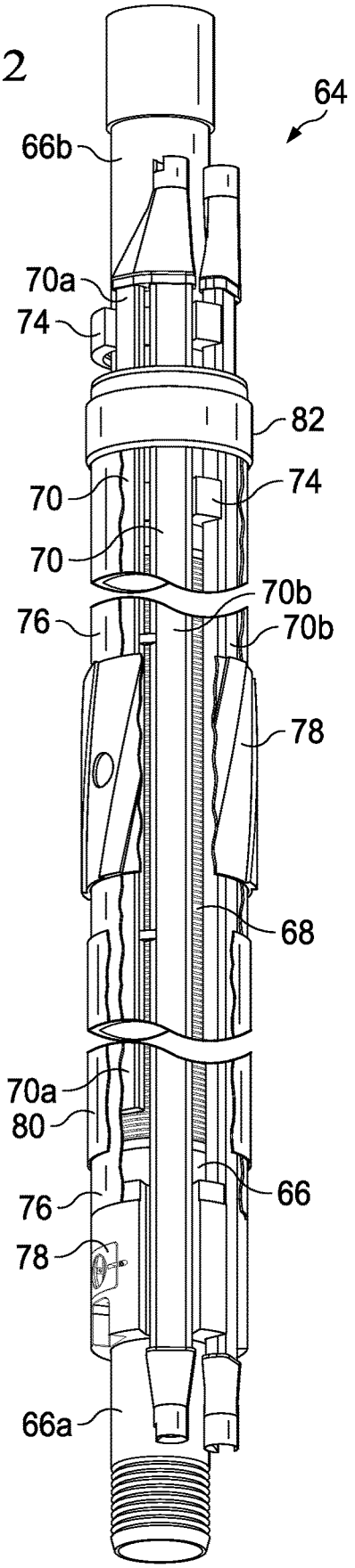
FIG. 2 is a perspective partial cut-away view of a completion joint from the well-screen assembly of FIG. 1, according to an exemplary embodiment.

Referring to FIG. 2 with continuing reference to FIG. 1, the well-screen assembly 58 includes a plurality of completion joints 64 made up in series with one another, one of which is shown in FIG. 2. Each completion joint 64 is made-up as part of the well-screen assembly 58 before it is run downhole from the oil or gas platform 10 for completion operations. Each completion joint 64 includes a base pipe 66 and a screen 68 concentrically disposed thereabout. The base pipe 66 has a first end portion 66*a* and a second end portion 66*b*. A plurality of openings (not shown) are formed along intervals in the base pipe 66 beneath the screen 68, thereby allowing fluid to pass into the lower completion string 50. In an exemplary embodiment, the screen 68 is a filter formed of wire or synthetic mesh disposed along the outer surface of the base pipe 66. In several exemplary embodiments, the screen 68 is an elongated tubular member disposed on the base pipe 66 so as to define an annular flow passage (not shown) between the base pipe 66 and the screen 68. The annular flow passage (not shown) directs fluid flow towards the plurality of openings (not shown) in the base pipe 66 and into the lower completion string 50. Each completion joint 64 may also include one or more shunt tubes 70 longitudinally disposed along the outer surface of the base pipe 66 and the screen 68. Each shunt tube 70 includes a packing tube 70*a* spaced in a parallel relation from a transport tube 70*b*. The packing tube 70*a* branches off from the transport tube 70*b* and includes nozzles (not shown) which direct the flow of the slurry into the annulus 54. Jumper tubes 70*c* (not visible in FIG. 2 but shown in FIG. 3B) are connected between corresponding transport tubes 70*b* of successive completion joints 64. The shunt tubes 70 are supported in place by support members 74. The support members 74 are disposed on the base pipe 66 and support the shunt tubes 70 in a generally parallel orientation with one another. A tubular outer shroud 76 is disposed about the completion joint 64 and mounted over the support members 74, thereby covering respective portions of the base pipe 66, the screen 68, and the shunt tubes 70. Each completion joint 64 also includes a locking mechanism 78, a tubular sliding shroud 80, and a shroud retaining member 82, all of which will be described in further detail below.

During the above described gravel-packing operation, in several exemplary embodiments, the packing tubes 70*a*, the transport tubes 70*b*, and the jumper tubes 70*c* operate to prevent sand-bridging. When a sand-bridge begins to form in the annulus 54, the slurry is forced to enter the transport tubes 70*b* from the annulus 54. The slurry then flows along the well-screen assembly 58, through the transport tubes 70*b* and jumper tubes 70*c* from one completion joint 64 to the next until the slurry is past the sand-bridge, at which point the slurry flows from the transport tubes 70*b* into the packing tubes 70*a* and is directed back into the annulus 54 by the nozzles.

Figure 3A:
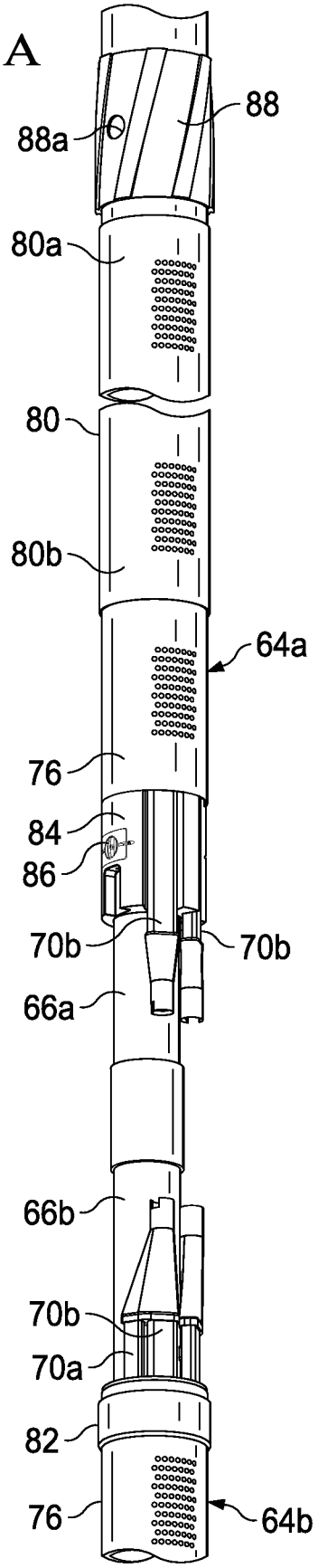
FIGS. 3A-3D each illustrate a perspective partial-sectional view of the well-screen assembly of FIG. 1, including two completion joints substantially identical to the completion joint of FIG. 2 and connected in series with one another, according to an exemplary embodiment.
Figure 3B:
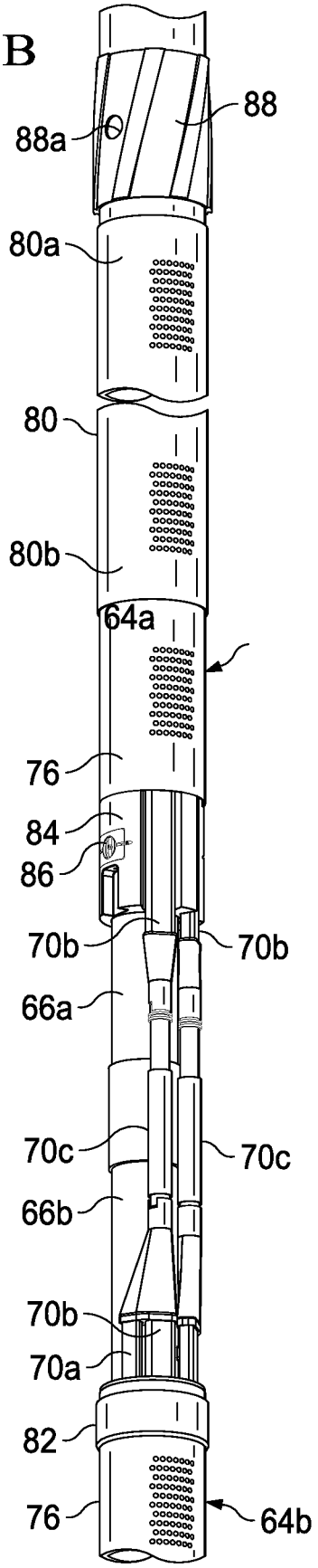

In an exemplary embodiment, the well-screen assembly 58 includes several completion joints 64 connected in series with one another, a pair of which are illustrated in FIGS. 3A-3D. In order to assemble the well-screen assembly 58, successive connections are made-up between adjacent ones of the completion joints 64 on the floor of the oil or gas platform 10. Each successive connection is made-up after the previously connected pair of completion joints 64 have been displaced toward the wellbore 38 and/or the casing string 40. The process of making-up the connection between adjacent ones of the completion joints 64 will be described in detail below. Specifically, in connection with FIGS. 3A-3D and FIG. 4, the process of connecting a first completion joint 64*a* to a second completion joint 64*b* will be described, the first and second completion joints 64*a*, 64*b* being substantially identical to the completion joint 64 described above. As shown in FIGS. 3A and 3B, the first and second completion joints 64*a*, 64*b* are connected in series with one another. Specifically, the first end portion 66*a* of the base pipe 66 from the first completion joint 64*a* is threadably connected to the second end portion 66*b* of the base pipe 66 from the second completion joint 64*b*, as shown in FIG. 3A, thereby forming a pin and box connection and providing fluid communication between the base pipes 66 of the first and second completion joints 64*a*, 64*b*. Once the respective base pipes 66 of the first and second completion joints 64*a*, 64*b* have been connected, the jumper tubes 70*c* are installed, as shown in FIG. 3B. The jumper tubes 70*c* couple each transport tube 70*b* disposed along the first completion joint 64*a* to the corresponding transport tube 70*b* disposed along the second completion joint 64*b*, thereby providing fluid communication between the transport tubes 70*b* of the first and second completion joints 64*a*, 64*b*, respectively.

Figure 3C:
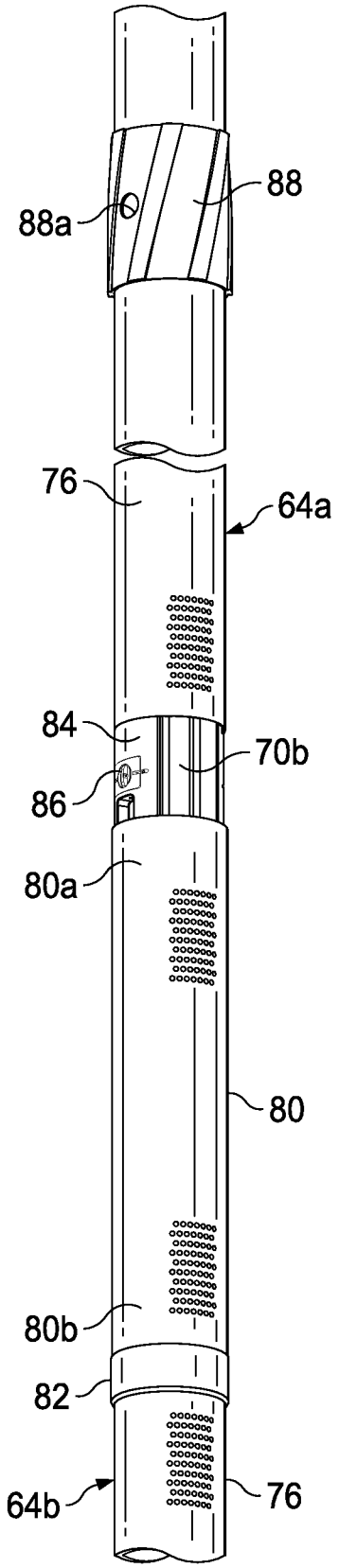
Figure 3D:
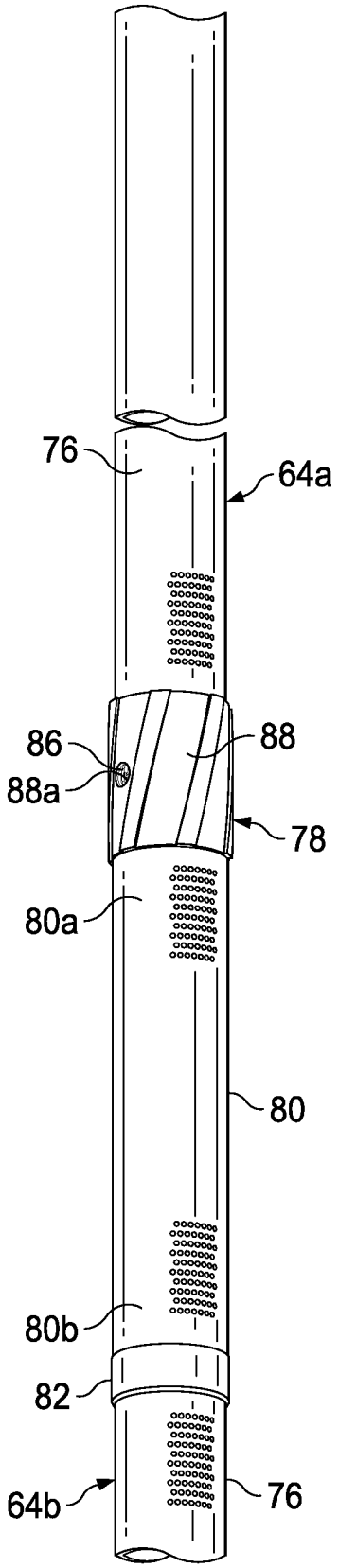

Once the first and second completion joints 64*a*, 64*b* have been connected as described above, the sliding shroud 80 may be displaced from its initial position, as shown in FIGS. 3A and 3B, to a run-in position, as shown in FIGS. 3C and 3D. In the run-in position, the sliding shroud 80 is disposed about the jumper tubes 70*c* and respective portions of the first and second completion joints 64*a*, 64*b*, thereby covering and protecting the jumper tubes 70*c* when the first and second completion joints 64*a*, 64*b* are disposed within the wellbore 38. The sliding shroud 80 includes a first end portion 80*a* and a second end portion 80*b*. The shroud retaining member 82 is adapted to receive the second end portion 80*b* of the sliding shroud 80 as the sliding shroud 80 is displaced into the run-in position, as shown in FIG. 3C. The shroud retaining member 82 may be formed, for example, on the outer shroud 76 of the second completion joint 64*b*.

Once the sliding shroud 80 is in the run-in position, the locking mechanism 78 is operable to secure the first end portion 80*a* of the sliding shroud 80 to the first completion joint 64*a*, as shown in FIG. 3D. The locking mechanism 78 includes a support member 84, a retractable key 86, and a tubular locking member 88. When the sliding shroud is placed in the run-in position, the upper end 80*a* of the sliding shroud 80 is located proximate the support member 84. The tubular locking member 88 is adapted to be displaced longitudinally from its initial position, as shown in FIGS. 3A-3C, to a locking position, as shown in FIG. 3D, in which the tubular locking member 88 is disposed about the support member 84. Once the sliding shroud 80 is in the run-in position and the tubular locking member 88 is in the locking position, the retractable key 86 is operable to secure the tubular locking member 88 in the locking position, as will be discussed in further detail below. In an exemplary embodiment, the tubular locking member 88 is a centralizer. In an exemplary embodiment, the tubular locking member 88 is a sleeve that does not include centralizer vanes. In another exemplary embodiment, the tubular locking member 88 is integrally formed with the first end portion 80*a* of the sliding shroud 80.

As shown in FIG. 3D, in the locking position, the tubular locking member 88 is disposed about the support member 84 and the first end portion 80*a* of the sliding shroud 80. In an exemplary embodiment, the support member 84 supports the shunt tubes 70. The retractable key 86 is adapted to be moveable between a retracted position and a deployed position. In the retracted position, the retractable key 86 nests within the support member 84 such that the sliding shroud 80 and the tubular locking member 88 may slide freely past the support member 84 into the run-in position and the locking position, respectively. In the deployed position, the retractable key 86 protrudes from the support member 84. An access port 88*a* is formed through the tubular locking member 88, allowing access to the retractable key 86 when the tubular locking member 88 is disposed about the support member 84. Once the tubular locking member 88 is in the locking position, the retractable key 86 may be manipulated through the access port 88*a* and moved to the deployed position in order to secure the tubular locking member 88 about the support member 84.

Figure 4:
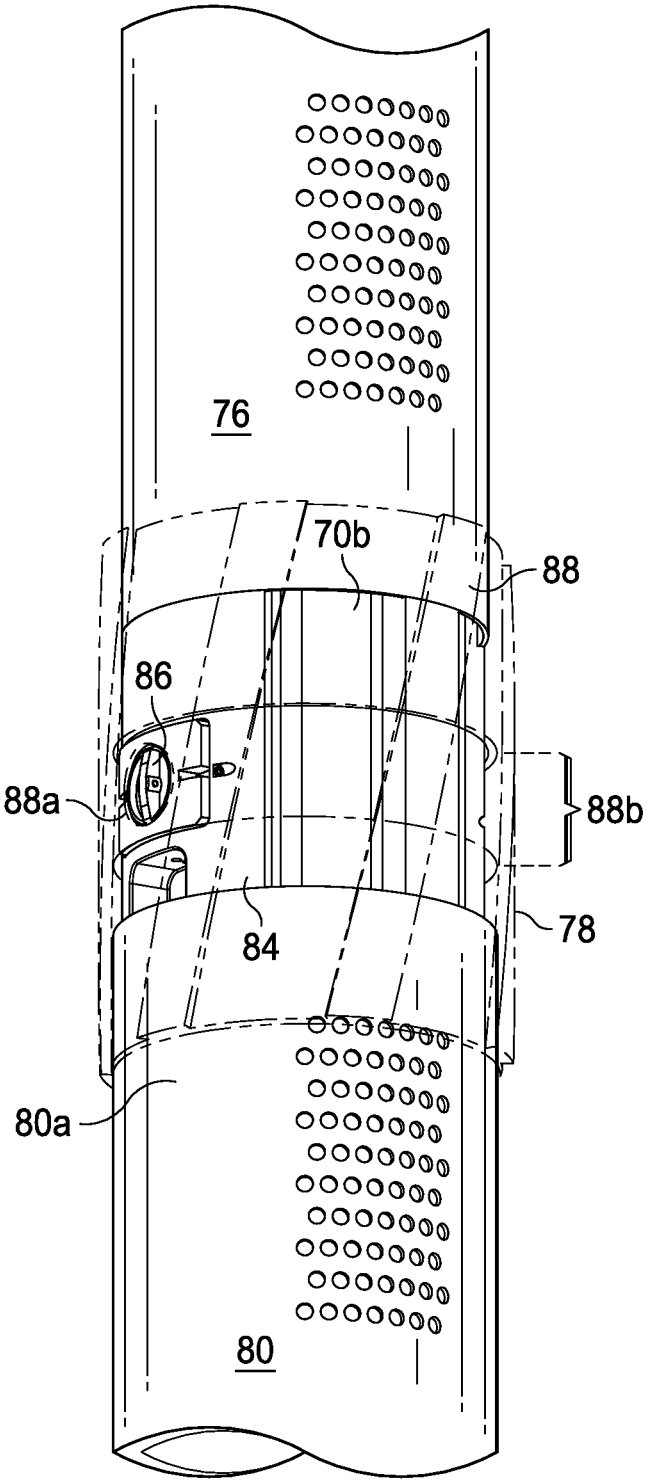
FIG. 4 is an enlarged perspective view of a portion of FIG. 3D including a locking mechanism, according to an exemplary embodiment.

As shown in FIG. 4 with continuing reference to FIGS. 3A-3D, the retractable key 86 remains in the retracted position until the tubular locking member 88 is moved to the locking position. Once the tubular locking member 88 is in the locking position, the retractable key 86 may be accessed through the access port 88*a* and placed in the deployed position. The retractable key 86 extends into a cavity 88*b* formed into the tubular locking member 88 and secures the tubular locking member 88 about the support member 84, thereby trapping the sliding shroud 80 in the run-in position between the shroud retaining member 82 and the locking mechanism 78. When the sliding shroud 80 is trapped in the run-in position, respective portions of the base pipes 66 and the shunt tubes 70 that are longitudinally disposed between the outer shrouds 76 of the first and second completion joints 64*a*, 64*b* are covered by the sliding shroud 80, the tubular locking member 88, and the shroud retaining member 82. During the installation and/or operation of the well-screen assembly 58, the tubular locking member 88, the shroud retaining member 82, and the sliding shroud 80 protect the connection between the first completion joint 64*a* and the second completion joint 64*b*, including at least the jumper tubes 70*c*, from any damaging impacts. In an exemplary embodiment, the tubular locking member 88 is omitted and the access port 88*a* and cavity 88*b* are formed as part of the sliding shroud 80 itself. In an exemplary embodiment, the above described locking mechanism 78, sliding shroud 80, and shroud retaining member 82 increase the reliability of the connection between successive completion joints 64, reduce the potential for failures in comparison with commonly used designs in shunt systems, and shorten the installation time of successive completion joints 64 on the oil or gas platform 10.

Figure 5:
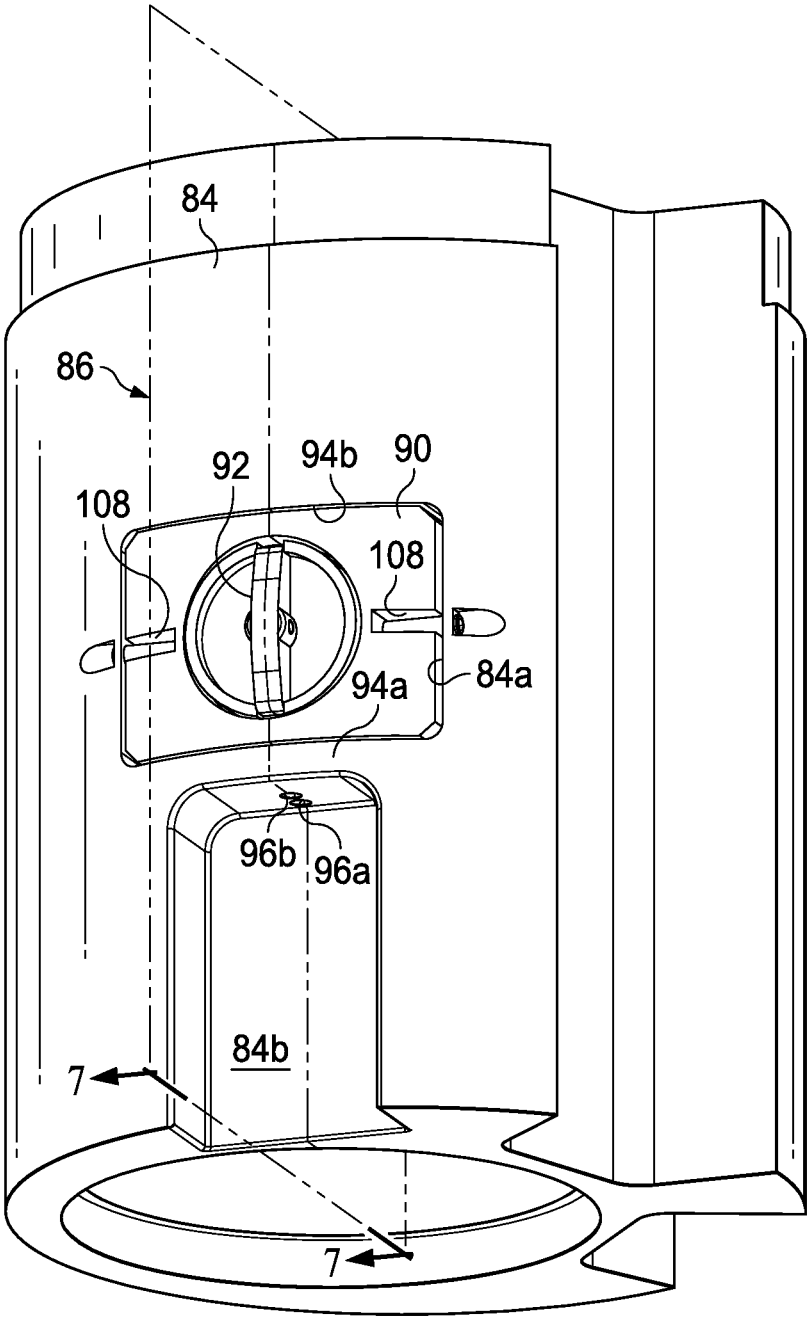
FIG. 5 is a perspective view of a portion of the locking mechanism of FIG. 4, according to an exemplary embodiment.

In an exemplary embodiment, as illustrated in FIG. 5, the retractable key 86 includes a body 90 and a latch 92. The body 90 of the retractable key 86 is complementarily disposed within a groove 84*a* formed into the support member 84. In an exemplary embodiment, the profiles of the groove 84*a* and the body 90 may form any one of a number of shapes such as, for example, circular shapes, triangular shapes, rectangular shapes, polygonal shapes, other planar shapes, or any combination thereof. A recess 84*b* is formed into the support member 84 of the locking mechanism 78 proximate the groove 84*a*. A wall 94*a* is defined between the groove 84*a* and the recess 84*b*. The recess 84*b* extends from below the groove 84*a* toward the lower edge of the support member 84. The recess 84*b* is formed to allow a tool (not shown) to drill a pair of pin-holes 96*a*, 96*b* through the wall 94*a* during the manufacture of the locking mechanism 78. The pin-holes 96*a*, 96*b* are spaced in a parallel relation and extend from the recess 84*b* longitudinally through the wall 94*a* and into an opposing wall 94*b* of the groove 84*a*. In an exemplary embodiment, the recess 84*b* is omitted and the pin-holes 96*a*, 96*b* are formed by another mechanical process, drilling or otherwise.

Figure 6:
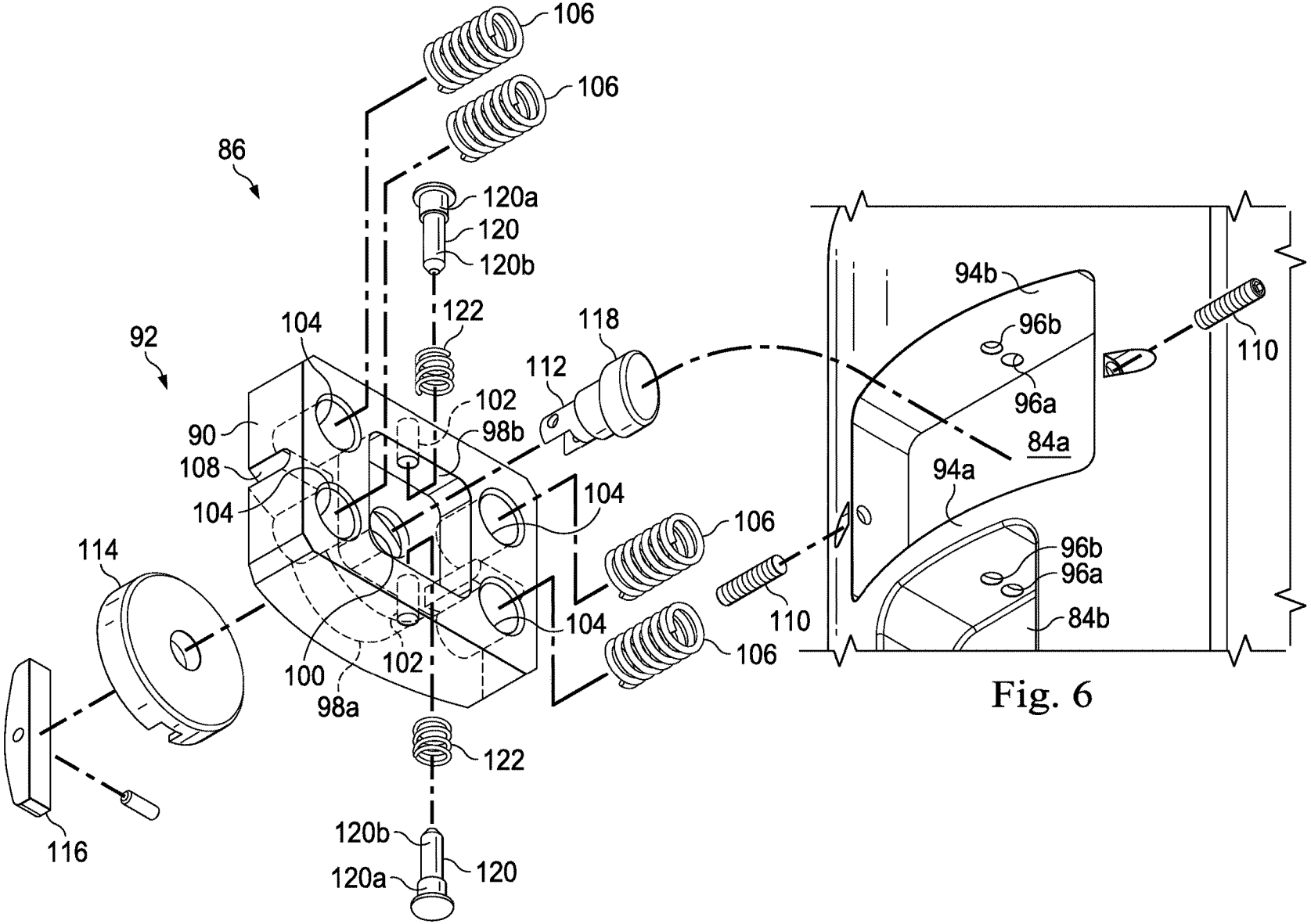
FIG. 6 is an exploded view of the portion of the locking mechanism shown in FIG. 5, according to an exemplary embodiment.

In an exemplary embodiment, as illustrated in FIG. 6 with continuing reference to FIG. 5, the components of the latch 92 are adapted to fit within a housing formed into the body 90. The housing is defined by a pair of flat-bottomed holes 98*a*, 98*b*, a guide-hole 100, and a pin-hole 102. The flat-bottomed hole 98*a* is formed into the front of the body 90 and the flat-bottomed hole 98*b* is formed into the back of the body 90. The profile of the flat-bottomed hole 98*a* forms a generally circular shape and the profile of the flat-bottomed hole 98*b* forms a generally square shape. In an exemplary embodiment, the profile of the flat-bottomed hole 98*b* may form a shape that is not a square, such as, for example, a circular shape or the shape of another polygon. Each flat-bottomed hole 98*a*, 98*b* has a depth, the depths being configured such that a portion of the body remains between the flat-bottomed holes 98*a*, 98*b*. The guide-hole 100 is formed centrally through the remaining portion of the body 90 between the flat-bottomed holes 98*a*, 98*b*. The pin-hole 102 extends through opposing side-walls of the flat-bottomed hole 98*b* and continues through the corresponding edges of the body 90, thereby forming a pair of openings. The pin-hole 102 is alternately aligned with the pin-hole 96*a* or the pin-hole 96*b* as the body 90 is received within the groove 84*a*.

In an exemplary embodiment, with continuing reference to FIG. 6, one or more flat-bottomed holes 104 are formed into the back of the body 90. Each flat-bottomed hole 104 accommodates a biasing member 106, which is compressed between the support member 84 and the bottom of the flat-bottomed hole 104, thereby spring-loading the retractable key 86. The biasing members 106 mechanically urge the retractable key 86 outward from the groove 84*a*. In an exemplary embodiment, the biasing members 106 are springs. In several exemplary embodiments, the biasing members 106 are another type of biasing members that are not springs, such as, for example, hydraulic cylinders, gas-filled cylinders, magnets, other types of biasing members, or any combination thereof. One or more retaining channels 108 are formed into the front of the body 90 at the edges thereof. The one or more retaining channels 108 each accommodate a retaining pin 110. Each retaining pin 110 is fixed to the support member 84 and extends from a side-wall of the groove 84*a* into the corresponding retaining channel 108. As the biasing members 106 urge the retractable key 86 outward from the groove 84*a*, the retaining pins 110 bottom-out in the retaining channels 108, thereby at least partially retaining the body 90 of the retractable key 86 in the groove 84*a*.

Figure 7A:
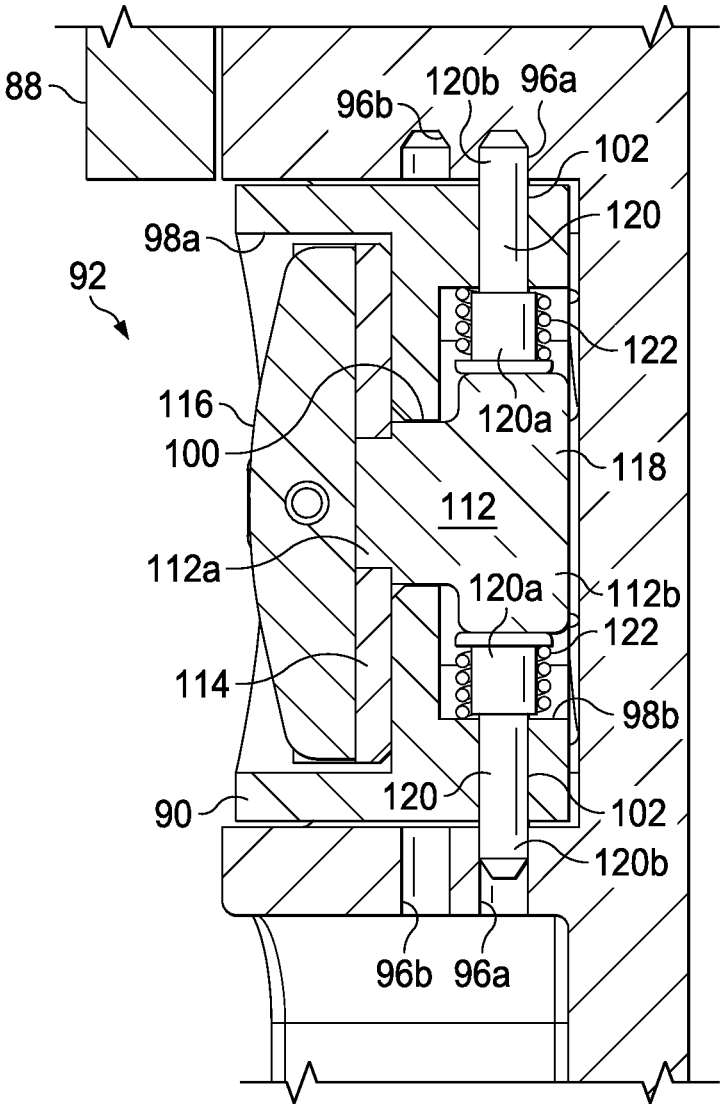
FIGS. 7A-7D each illustrate a cross-sectional view of the portion of the locking mechanism shown in FIG. 5, each of the respective cross-sectional views being taken along line 7-7 of FIG. 5 and depicting different operational positions of the locking mechanism, according to an exemplary embodiment.
Figure 7B:
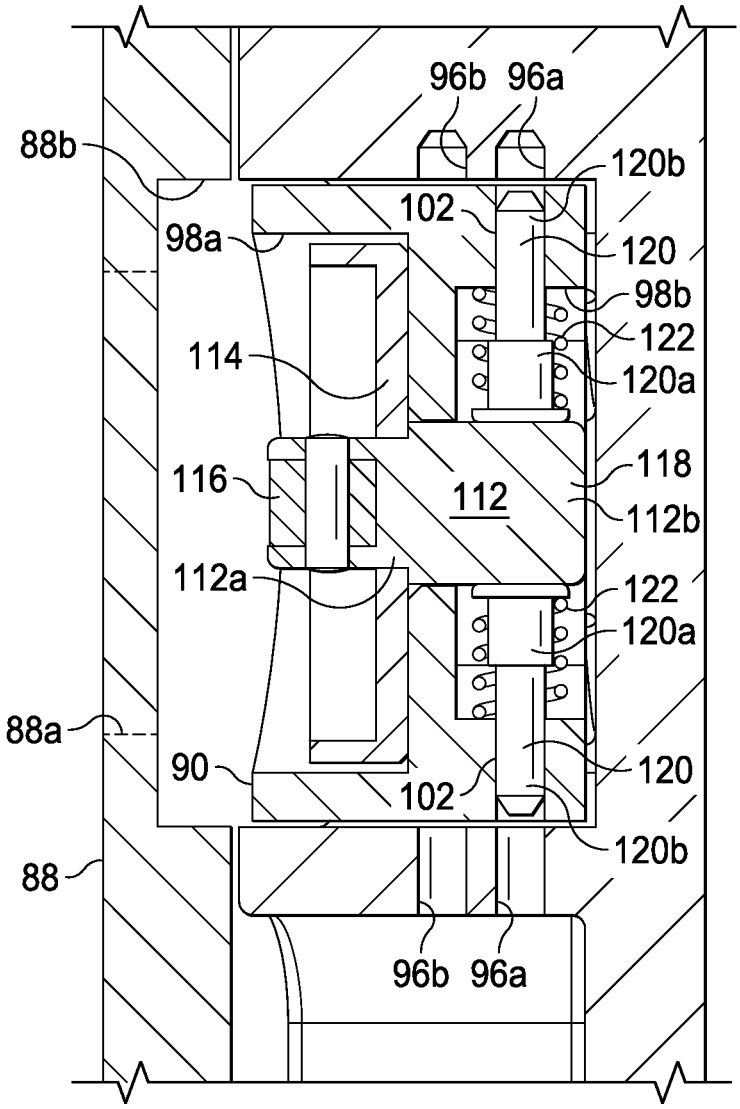
Figure 7C:
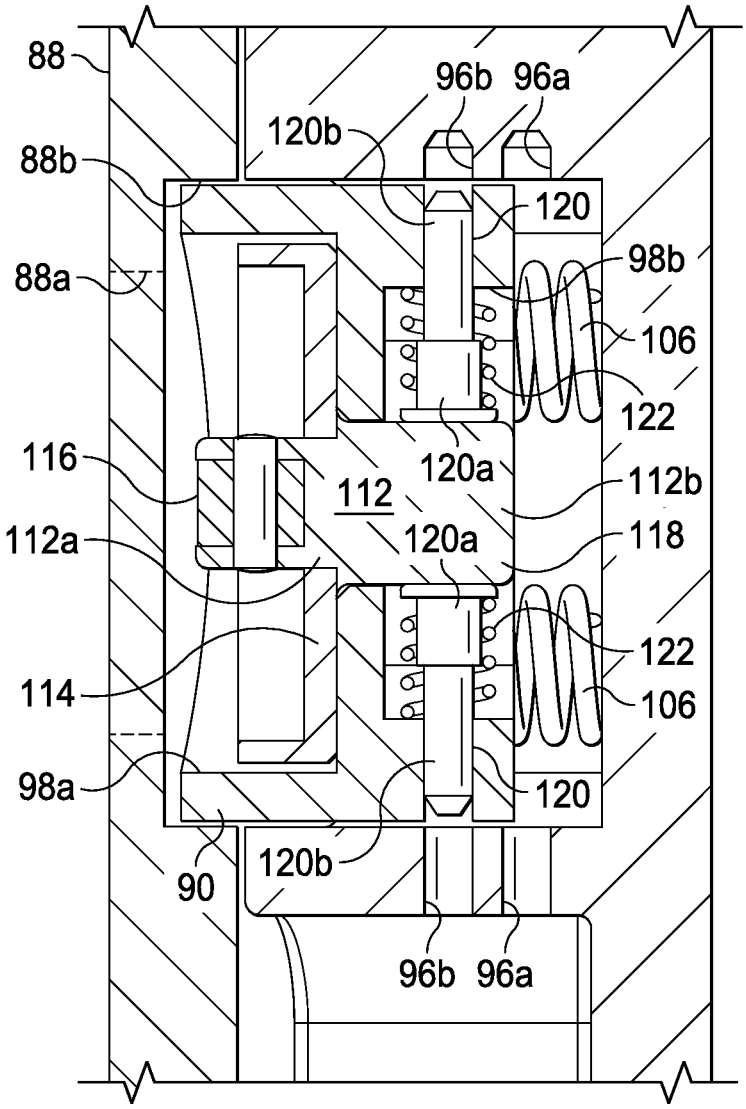
Figure 7D:
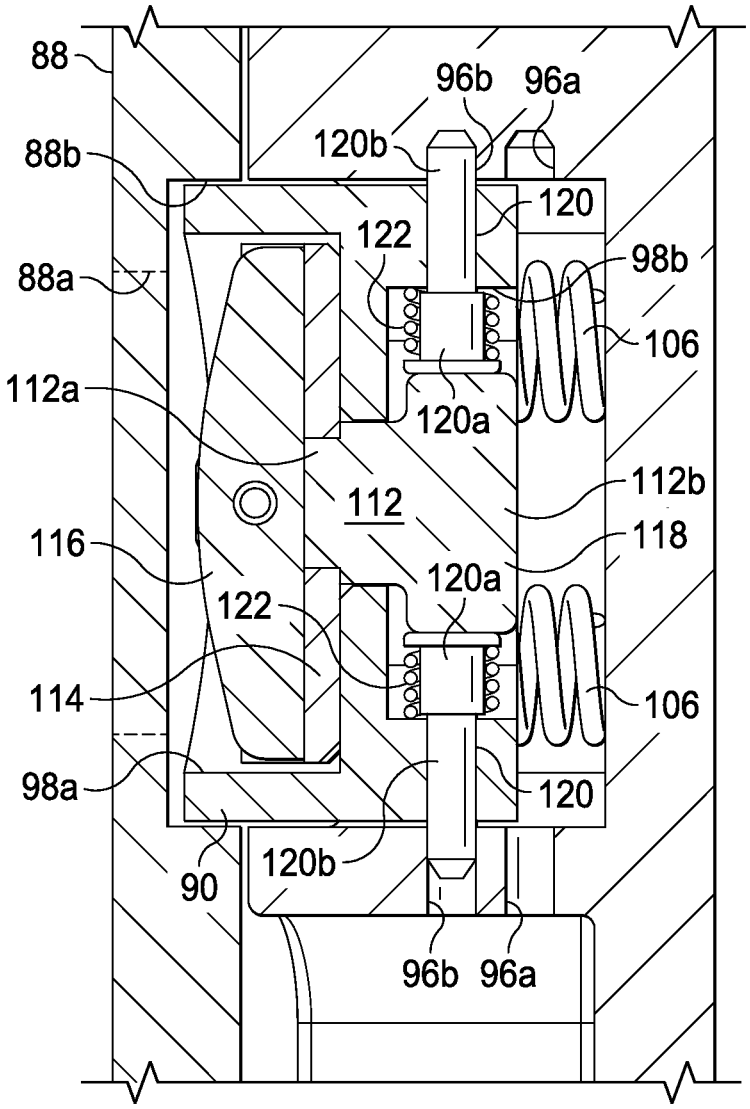

In an exemplary embodiment, as shown in FIGS. 7A-7D, with continuing reference to FIGS. 5 and 6, the latch 92 includes a cam-shaft 112, a disc 114, a handle 116, a cam 118, and a pair of locking-pins 120. The guide-hole 100 supports the cam-shaft 112, which defines first and second end portions 112*a*, 112*b* extending within the flat-bottomed holes 98*a* and 98*b*, respectively. The disc 114 is disposed within the flat-bottomed hole 98*a*. The first end portion 112*a* of the cam-shaft 112 extends through the disc 114 and is coupled to the handle 116, thereby trapping the disc 114 in the flat-bottomed hole 98*a*. In an exemplary embodiment, the handle 116 and the disc 114 are integrally formed. The cam 118 is connected to the second end portion 112*b* of the cam-shaft 112 and is disposed within the flat-bottomed hole 98*b*. The locking-pins 120 each define a proximal end portion 120*a* and a distal end portion 120*b*. The distal end portions 120*b* of the locking-pins 120 are supported within the pair of openings formed by the pin-hole 102 through opposing side-walls of the flat-bottomed hole 98*b*. The proximal end portions 120*a* of the locking-pins 120 are each urged into contact with the cam 118 by a spring 122, each spring 122 being concentrically disposed about one of the locking-pins 120. Each spring 122 is compressed between the side-wall of the flat-bottomed hole 98*b* and the proximal end portion 120*a* of one of the locking-pins 120. The springs 122 urge the locking-pins 120 radially toward the cam 118, thereby engaging the proximal end portions 120*a* of the locking-pins 120 with the cam 118. The cam 118 defines a continuous outer profile having a relatively smaller diameter portion and a relatively larger diameter portion. When the proximal end portions 120*a* of the locking-pins 120 are urged into contact with the relatively smaller diameter portion of the cam 118, as shown in FIGS. 7B and 7C, the distal end portions 120*b* of the locking-pins 120 do not extend into either of the pin-holes 96*a*, 96*b*. Alternatively, when the proximal end portions 120*a* of the locking-pins 120 are urged into contact with the relatively larger diameter portion of the cam 118, as shown in FIGS. 7A and 7D, the distal end portions 120*b* of the locking-pins 120 extend into either the pin-hole 96*a* or the pin-hole 96*b*. A smooth transition between the relatively smaller diameter portion and the relatively larger diameter portion of the cam 118 allows the proximal end portions 120*a* of the locking-pins 120 to track the profile of the cam 118 as the handle 116 is rotated. As a result, when the handle 116 is rotated, the distal end portions 120*b* are either driven into the pin-hole 96*a* or 96*b*, or retracted from the pin-hole 96*a* or 96*b*. In an exemplary embodiment, the cam 118 is omitted and another type of mechanical linkage is utilized to drive and retract the locking-pins 120 into, and out of, the pin-hole 96*a* or 96*b*.

FIGS. 7A and 7B illustrate the retractable key 86 in the retracted position. In the retracted position, the body 90 is pressed into the groove 84*a*, thereby aligning the pin-hole 102 formed through the side-walls of the flat-bottomed hole 98*b* with the pin-hole 96*a* formed into the walls 94*a*, 94*b* of the groove 84*a*. In order to lock the retractable key in the retracted position, as shown in FIG. 7A, the handle 116 is rotated. The cam 118 rotates along with the handle 116 and the proximal end portions 120*a* of the locking-pins 120 track the profile of the cam 118, thereby driving the distal end portions 120*b* of the locking-pins 120 through the pin-hole 102 and into the pin-hole 96*a*.

FIGS. 7C and 7D illustrate the retractable key 86 in the deployed position. In the deployed position, the body 90 is urged outward from the groove 84*a* by the biasing members 106 until the retaining pins 110 bottom-out in the retaining channels 108, thereby aligning the pin-hole 102 with the pin-hole 96*b*. In order to lock the retractable key in the deployed position, as shown in FIG. 7D, the handle 116 is rotated. The cam 118 rotates along with the handle 116 and the proximal end portions 120*a* of the locking-pins 120 track the cam 118, thereby driving the distal end portions 120*b* of the locking-pins 120 through the pin-hole 102 and into the pin-hole 96*b*.

In an exemplary embodiment, in order to make-up the connection between the first and second completion joints 64*a*, 64*b* on the floor of the oil or gas platform 10, the base pipes 66 of the first and second completion joints 64*a*, 64*b* are connected to one another. The jumper tubes 70*c* are then coupled between corresponding ones of the transport tubes 70*b* disposed along the first and second completion joints 64*a*, 64*b*. Once the respective base pipes 66 and transport tubes 70*b* have been connected, the sliding shroud 80 is displaced until it reaches the run-in position. In the run-in position, the second end portion 80*b* of the sliding shroud 80 is received by the shroud retaining member 82 and the first end portion 80*a* of the sliding shroud 80 is located proximate the support member 84. The tubular locking member 88 is then displaced until it reaches the locking position. During the displacement of the sliding shroud 80 and the tubular locking member 88, the retractable key 86 remains locked in the retracted position. Once the tubular locking member 88 has been placed in the locking position, the handle 116 is rotated through the access port 88*a*. As the handle 116 is rotated, the springs 122 bias the locking-pins 120 toward the cam 118, causing the proximal end portions 120*a* of the locking-pins 120 to track the cam 118 from the relatively larger diameter portion to the relatively smaller diameter portion thereof. The distal end portions 120*b* of the pins 120 are retracted from the pin-hole 96*a* as the proximal end portions 120*a* track the cam 118, thereby unlocking the retractable key 86. Once the retractable key 86 is unlocked, the biasing members 106 mechanically urge the body 90 outward from the groove 84*a* into the deployed position. In the deployed position, a portion of the body 90 is disposed within the cavity 88*b* formed on the interior surface of the tubular locking member 88. The retractable key 86 is locked in the deployed position by rotating the handle 116 through the access port 88*a*. As the handle 116 is rotated, the proximal end portions 120*a* of the locking-pins 120 track the cam 118 from the relatively smaller diameter portion to the relatively larger diameter portion thereof, driving the distal end portions 120*b* of the locking-pins 120 into the pin-hole 96*b*. Once the retractable key 86 has been locked in the deployed position, it secures the tubular locking member 88 about the locking mechanism 78, thereby trapping the sliding shroud 80 between the tubular locking member 88 and the shroud retaining member 82. In this position, the sliding shroud 80, the shroud retaining member 82, and the tubular locking member 88 protect the connection between the first and second completion joints 64*a*, 64*b* from damaging impacts when they are disposed within the wellbore 38. In an exemplary embodiment, the first and second completion joints 64*a*, 64*b* do not require any small tools (wrenches, screwdrivers, etc.) in order to be made-up on the oil or gas platform 10.

Figure 8:
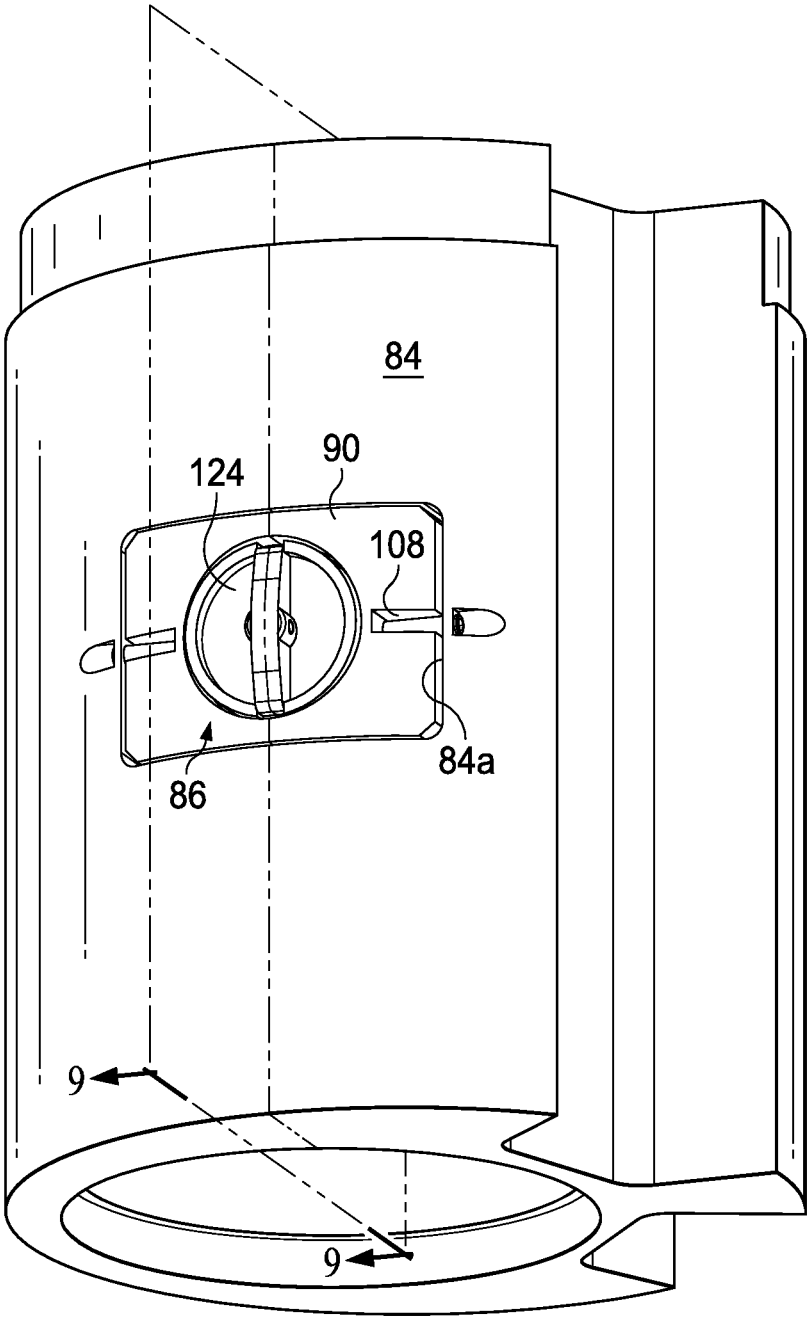
FIG. 8 is a perspective view of a portion of the locking mechanism of FIG. 4, according to another exemplary embodiment.
Figure 9A:
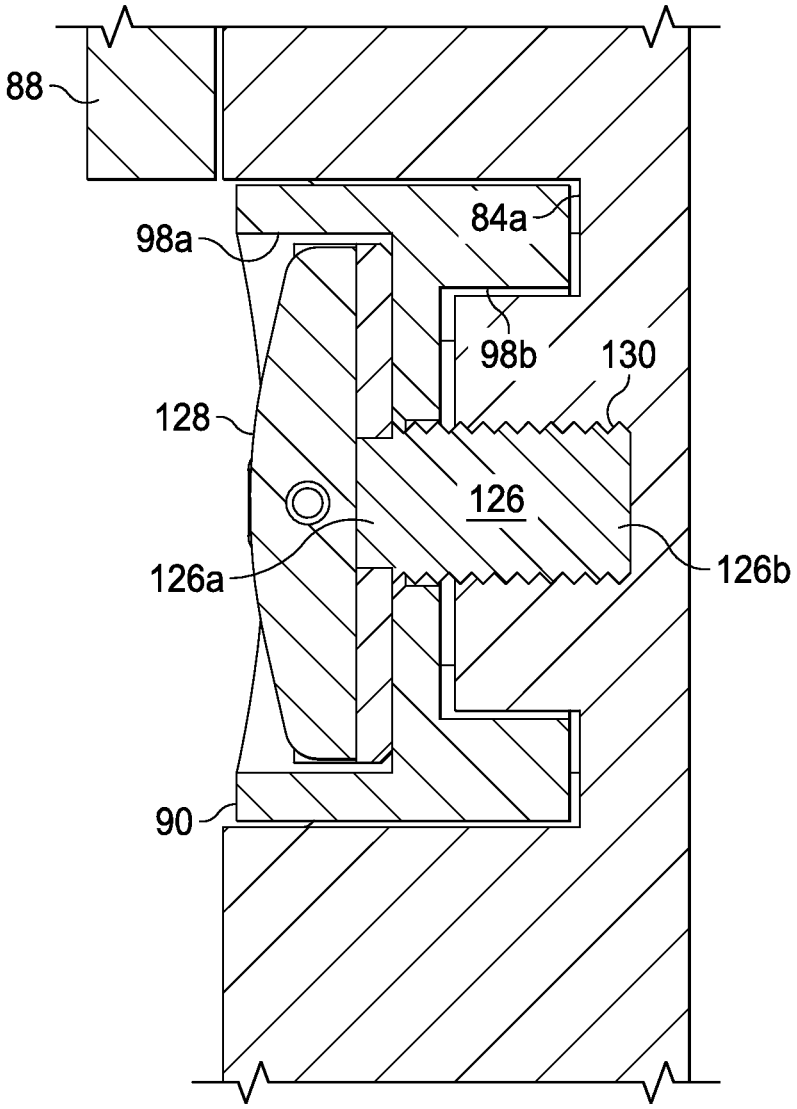
FIGS. 9A and 9B each illustrate a cross-sectional view of the portion of the locking mechanism shown in FIG. 8, each of the respective cross-sectional views being taken along line 9-9 of FIG. 8 and depicting different operational positions of the locking mechanism, according to an exemplary embodiment.
Figure 9B:
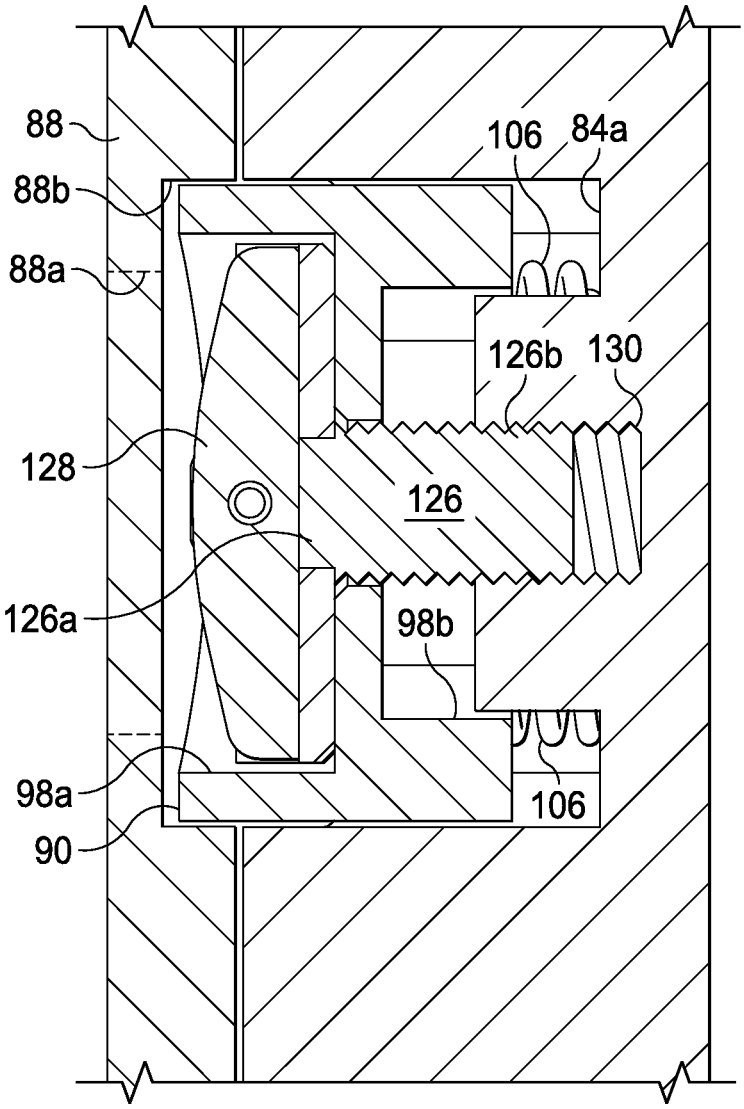

In an exemplary embodiment, as illustrated in FIG. 8 and FIGS. 9A and 9B, the components of the latch 92, including the cam-shaft 112, the disc 114, the handle 116, the cam 118, and the pair of locking-pins 120 are omitted in favor of a screw mechanism 124. Additionally, the pin-hole 102 formed through opposing sidewalls of the flat-bottomed hole 98*b* is omitted. The screw mechanism 124 includes a shaft 126 having a proximal end portion 126*a* and a distal end portion 126*b*. The proximal end portion 126*a* is attached to a handle 128, which fits complementarily within the flat-bottomed hole 98*a*. The distal end portion 126*b* is threaded and extends within the flat-bottomed hole 98*b*. A threaded hole 130 is formed into the bottom of the groove 84*a*. The distal end portion 126*b* is threaded into the threaded hole 130. The body 90 of the retractable key 86 is displaced into the retracted position by manipulating the handle 128 to thread the distal end portion 126*b* of the shaft 126 into the threaded hole 130. Alternatively, the body 90 of the retractable key 86 is displaced into the deployed position by manipulating the handle 128 to thread the distal end portion 126*b* of the shaft 126 out of the threaded hole 130.

The present disclosure introduces an assembly adapted to be disposed within a wellbore, the assembly including first and second completion joints, each of which includes a base pipe; a shunt tube disposed along the base pipe; and a tubular outer shroud disposed about respective portions of the shunt tube and the base pipe; a jumper tube coupling the shunt tube of the first completion joint to the shunt tube of the second completion joint; and a tubular sliding shroud disposed about at least one of the first and second completion joints and adapted to slide longitudinally to a run-in position, in which the tubular sliding shroud is disposed about the jumper tube and respective portions of the first and second completion joints, thereby covering the jumper tube. In an exemplary embodiment, respective portions of the base pipes and shunt tubes that are longitudinally disposed between the tubular outer shrouds of the first and second completion joints are covered by the tubular sliding shroud when the tubular sliding shroud is placed in the run-in position. In an exemplary embodiment, a locking mechanism connected to the first completion joint and a retaining member connected to the second joint; wherein the locking mechanism and the retaining member, in combination, are adapted to secure the tubular sliding shroud in the run-in position; and wherein the locking mechanism is operable to secure a first end portion of the tubular sliding shroud and the retaining member is operable to secure a second end portion of the tubular sliding shroud. In an exemplary embodiment, the locking mechanism includes a support member connected to the first joint; a groove formed into the support member; a key disposed at least partially within the groove; a tubular locking member adapted to be disposed about the first joint, and adapted to slide longitudinally relative to the support member into a locking position; and a cavity formed into the tubular locking member; wherein when the tubular locking member is in the locking position, the tubular locking member is disposed about the support member and the first end portion of the tubular sliding shroud. In an exemplary embodiment, the key is moveable between a retracted position and a deployed position; wherein the key nests within the groove when the key is in the retracted position, such that the tubular sliding shroud and the tubular locking member can slide freely past the support member into the run-in position and the locking position, respectively; wherein the key protrudes from the support member when the key is in the deployed position; and wherein the cavity is adapted to receive the key when the tubular locking member is in the locking position and the key is in the deployed position. In an exemplary embodiment, when the tubular locking member is in the locking position and the key is in the deployed position, the key secures the tubular locking member in the locking position and obstructs longitudinal displacement of the tubular sliding shroud in a first direction. In an exemplary embodiment, the retaining member secures the second end portion of the tubular sliding shroud to the second completion joint when the sliding shroud is in the run-in position, thereby obstructing longitudinal displacement of the tubular sliding shroud in a second direction that is opposite the first direction. In an exemplary embodiment, the tubular locking member is integrally formed with the first end portion of the tubular sliding shroud.

The present disclosure also introduces an apparatus adapted to be disposed within a wellbore, the apparatus including a support member; a groove formed into the support member; a key disposed at least partially within the groove; a tubular sliding member adapted to be displaced longitudinally relative to the support member into a locking position, in which the tubular sliding member is disposed about the support member; and a cavity formed into the tubular sliding member and adapted to receive the key when the tubular sliding member is in the locking position; wherein the key is disposed within both the groove and the cavity to secure the tubular sliding member in the locking position. In an exemplary embodiment, the key is moveable between a retracted position and a deployed position; wherein the key nests within the groove when the key is in the retracted position, such that the tubular sliding member can slide freely past the support member into the locking position; wherein the key protrudes from the support member when the key is in the deployed position; and wherein the cavity is adapted to receive the key when the tubular sliding member is in the locking position and the key is placed in the deployed position. In an exemplary embodiment, a threaded hole is formed into the support member; wherein the key includes a housing; a shaft supported within the housing, the shaft including opposing first and second end portions, the first end portion being threaded; and a handle disposed within the housing and connected to the second end portion of the shaft, the handle operable to rotate the shaft; wherein the key is placed in the retracted position by threading the first end of the shaft into the threaded hole; and wherein the key is placed in the deployed position by threading the first end of the shaft out of the threaded hole. In an exemplary embodiment, the groove defines first and second surfaces of the support member; wherein first and second pin-holes are formed into the first and second surfaces of the support member, respectively; and wherein the key includes a body having a housing formed therein; and a latch disposed within the housing, the latch including a shaft supported by the housing, the shaft including opposing first and second end portions; a handle connected to the first end portion of the shaft, the handle operable to rotate the shaft when the tubular sliding member is in the locking position; and a mechanical linkage connected to the second end portion of the shaft, the mechanical linkage operable to deploy a pin into one of the first and second pin-holes when the handle is rotated. In an exemplary embodiment, a biasing member disposed between the support member and the key, the biasing member operable to urge the key out of the groove; wherein the key is secured in the retracted position when the pin is deployed into the first pin-hole; and wherein the key is secured in the deployed position when the pin is deployed into the second pin-hole.

The present disclosure also introduces a method for making-up a connection between first and second completion joints, the method including providing the first and second completion joints, each of the first and second completion joints including a base pipe; a shunt tube disposed along the base pipe; and a tubular outer shroud disposed about respective portions of the shunt tube and the base pipe; coupling the shunt tube of the first completion joint to the shunt tube of the second completion joint with a jumper tube; shifting a tubular sliding shroud from a first position to a second position; and locking the tubular sliding shroud in the second position; wherein the tubular sliding shroud is disposed about at least one of the first and second completion joints in the first position; and wherein the tubular sliding shroud is disposed about the jumper tube and respective portions of the first and second completion joints in the second position. In an exemplary embodiment, locking the tubular sliding shroud in the second position includes securing a first end portion of the tubular sliding shroud with a locking mechanism; and securing a second end portion of the tubular sliding shroud with a retaining member. In an exemplary embodiment, the locking mechanism is connected to the first completion joint, and wherein securing the first end portion of the tubular sliding shroud with the locking mechanism includes shifting a tubular locking member from a third position to a fourth position; and locking the tubular locking member in the fourth position; wherein the tubular locking member is disposed about the tubular outer shroud of the first completion joint in the third position; and wherein the tubular locking member is disposed about a support member and the first end portion of the tubular sliding shroud in the fourth position, the support member being connected to the first joint. In an exemplary embodiment, the jumper tube and respective portions of the first and second completion joints, including respective portions of the base pipes and shunt tubes that are longitudinally disposed between the tubular outer shrouds of the first and second completion joints, are covered by at least one of the tubular sliding shroud and the tubular locking member when the tubular sliding shroud is in the second position and the tubular locking member is in the fourth position. In an exemplary embodiment, locking the tubular locking member in the fourth position includes deploying a key from a groove formed into the support member into a cavity formed into the tubular locking member by rotating a handle through an opening formed in the tubular locking member; wherein the key is disposed within both of the groove and the cavity when the key is deployed. In an exemplary embodiment, the tubular locking member is integrally formed with the first end portion of the tubular sliding shroud. In an exemplary embodiment, the retaining member is connected to the second completion joint; and wherein securing the second end portion of the tubular sliding shroud with the retaining member includes receiving the tubular sliding shroud within a portion of the retaining member as the tubular sliding shroud is displaced from the first position to the second position.

It is understood that variations may be made in the foregoing without departing from the scope of the disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been disclosed in detail above, the embodiments disclosed are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. An assembly adapted to be disposed within a wellbore, the assembly comprising:

first and second completion joints, each of which comprises:

a base pipe;

a shunt tube disposed along the base pipe; and a tubular outer shroud disposed about respective portions of the shunt tube and the base pipe;

a jumper tube coupling the shunt tube of the first completion joint to the shunt tube of the second completion joint; and a tubular sliding shroud disposed about at least one of the first and second completion joints and adapted to slide longitudinally to a run-in position, in which the tubular sliding shroud is disposed about the jumper tube and respective portions of the first and second completion joints, thereby covering the jumper tube;

wherein the assembly further comprises:

a locking mechanism connected to the first completion joint, the locking mechanism being operable to secure a first end portion of the tubular sliding shroud; and/or a retaining member connected to the second completion joint, the retaining member being operable to secure a second end portion of the tubular sliding shroud;

wherein the assembly comprises the locking mechanism connected to the first completion joint;

wherein the locking mechanism is adapted to at least partially secure the tubular sliding shroud in the run-in position;

wherein the locking mechanism comprises:

a support member connected to the first completion joint;

a groove formed into the support member;

a key disposed at least partially within the groove;

a tubular locking member adapted to be disposed about the first completion joint, and adapted to slide longitudinally relative to the support member into a locking position; and a cavity formed into the tubular locking member;

and wherein when the tubular locking member is in the locking position, the tubular locking member is disposed about the support member and the first end portion of the tubular sliding shroud.

2. The assembly of claim 1, wherein respective portions of the base pipes and shunt tubes that are longitudinally disposed between the tubular outer shrouds of the first and second completion joints are covered by the tubular sliding shroud when the tubular sliding shroud is placed in the run-in position.

3. The assembly of claim 1, wherein the key is moveable between a retracted position and a deployed position;

wherein the key nests within the groove when the key is in the retracted position, such that the tubular sliding shroud and the tubular locking member can slide freely past the support member into the run-in position and the locking position, respectively;

wherein the key protrudes from the support member when the key is in the deployed position; and wherein the cavity is adapted to receive the key when the tubular locking member is in the locking position and the key is in the deployed position.

4. The assembly of claim 3, wherein when the tubular locking member is in the locking position and the key is in the deployed position, the key secures the tubular locking member in the locking position and obstructs longitudinal displacement of the tubular sliding shroud.

5. The assembly of claim 4, wherein the tubular locking member is integrally formed with the first end portion of the tubular sliding shroud.

6. An apparatus adapted to be disposed within a wellbore, the apparatus comprising:

a tubular base pipe;

a tubular support member disposed about the tubular base pipe and defining an internal passage through which the tubular base pipe extends;

a groove formed into the tubular support member;

a key disposed at least partially within the groove;

a tubular sliding member adapted to be displaced longitudinally relative to the tubular support member into a locking position, in which the tubular sliding member is disposed about the tubular support member; and a cavity formed into the tubular sliding member and adapted to receive the key when the tubular sliding member is in the locking position;

wherein the key is adapted to be disposed within both the groove and the cavity to secure the tubular sliding member in the locking position;

wherein the tubular base pipe and the tubular support member are formed separately.

7. The apparatus of claim 6, wherein the key is moveable between a retracted position and a deployed position;

wherein the key nests within the groove when the key is in the retracted position, such that the tubular sliding member can slide freely past the tubular support member into the locking position;

wherein the key protrudes from the tubular support member when the key is in the deployed position; and wherein the cavity is adapted to receive the key when the tubular sliding member is in the locking position and the key is placed in the deployed position.

8. The apparatus of claim 6, wherein the tubular support member is adapted to support a jumper tube coupling a shunt tube of a first completion joint to a shunt tube of a second completion joint.

9. An apparatus adapted to be disposed within a wellbore, the apparatus comprising:

a support member;

a groove formed into the support member;

a key disposed at least partially within the groove;

a tubular sliding member adapted to be displaced longitudinally relative to the support member into a locking position, in which the tubular sliding member is disposed about the support member; and a cavity formed into the tubular sliding member and adapted to receive the key when the tubular sliding member is in the locking position;

wherein the key is adapted to be disposed within both the groove and the cavity to secure the tubular sliding member in the locking position;

wherein the key is moveable between a retracted position and a deployed position;

wherein the key nests within the groove when the key is in the retracted position, such that the tubular sliding member can slide freely past the support member into the locking position;

wherein the key protrudes from the support member when the key is in the deployed position;

wherein the cavity is adapted to receive the key when the tubular sliding member is in the locking position and the key is placed in the deployed position;

wherein a threaded hole is formed into the support member;

wherein the key comprises:

a housing;

a shaft supported within the housing, the shaft comprising opposing first and second end portions, the first end portion being threaded; and a handle disposed within the housing and connected to the second end portion of the shaft, the handle operable to rotate the shaft;

wherein the key is placed in the retracted position by threading the first end of the shaft into the threaded hole; and wherein the key is placed in the deployed position by threading the first end of the shaft out of the threaded hole.

10. An apparatus adapted to be disposed within a wellbore, the apparatus comprising:

a support member;

a groove formed into the support member;

a key disposed at least partially within the groove;

a tubular sliding member adapted to be displaced longitudinally relative to the support member into a locking position, in which the tubular sliding member is disposed about the support member; and a cavity formed into the tubular sliding member and adapted to receive the key when the tubular sliding member is in the locking position;

wherein the key is adapted to be disposed within both the groove and the cavity to secure the tubular sliding member in the locking position;

wherein the groove defines a surface of the support member;

wherein a pin-hole is formed into the surface of the support member; and wherein the key comprises:

a body having a housing formed therein; and a latch disposed within the housing, the latch comprising:

a shaft supported by the housing, the shaft comprising opposing first and second end portions;

a handle connected to the first end portion of the shaft, the handle operable to rotate the shaft when the tubular sliding member is in the locking position; and a mechanical linkage connected to the second end portion of the shaft, the mechanical linkage operable to deploy a pin into the pin-hole when the handle is rotated.

11. The apparatus of claim 10, further comprising a biasing member disposed between the support member and the key, the biasing member operable to urge the key out of the groove;

wherein the key is secured in a deployed position when the pin is deployed into the pin-hole.

12. A method for making-up a connection between first and second completion joints, the method comprising:

providing the first and second completion joints, each of the first and second completion joints comprising:

a base pipe;

a shunt tube disposed along the base pipe; and a tubular outer shroud disposed about respective portions of the shunt tube and the base pipe;

coupling the shunt tube of the first completion joint to the shunt tube of the second completion joint with a jumper tube;

shifting a tubular sliding shroud from a first position to a second position; and locking the tubular sliding shroud in the second position;

wherein the tubular sliding shroud is disposed about at least one of the first and second completion joints in the first position;

wherein the tubular sliding shroud is disposed about the jumper tube and respective portions of the first and second completion joints in the second position;

wherein locking the tubular sliding shroud in the second position comprises:

securing a first end portion of the tubular sliding shroud with a locking mechanism; and/or securing a second end portion of the tubular sliding shroud with a retaining member;

wherein locking the tubular sliding shroud in the second position comprises securing the first end portion of the tubular sliding shroud with the locking mechanism;

wherein the locking mechanism is connected to the first completion joint, and wherein securing the first end portion of the tubular sliding shroud with the locking mechanism comprises:

shifting a tubular locking member from a third position to a fourth position; and locking the tubular locking member in the fourth position;

and wherein the tubular locking member is disposed about a support member and the first end portion of the tubular sliding shroud in the fourth position, the support member being connected to the first completion joint.

13. The method of claim 12, wherein the jumper tube and respective portions of the first and second completion joints, including respective portions of the base pipes and shunt tubes that are longitudinally disposed between the tubular outer shrouds of the first and second completion joints, are covered by at least one of the tubular sliding shroud and the tubular locking member when the tubular sliding shroud is in the second position and the tubular locking member is in the fourth position.

14. The method of claim 12, wherein locking the tubular locking member in the fourth position comprises deploying a key from a groove formed into the support member into a cavity formed into the tubular locking member by rotating a handle through an opening formed in the tubular locking member;

wherein the key is disposed within both of the groove and the cavity when the key is deployed.

15. The method of claim 14, wherein the tubular locking member is integrally formed with the first end portion of the tubular sliding shroud.

16. An assembly adapted to be disposed within a wellbore, the assembly comprising:

first and second completion joints, each of which comprises:

a base pipe;

a shunt tube disposed along the base pipe; and a tubular outer shroud disposed about respective portions of the shunt tube and the base pipe;

a jumper tube coupling the shunt tube of the first completion joint to the shunt tube of the second completion joint; and a tubular sliding shroud disposed about at least one of the first and second completion joints and adapted to slide longitudinally to a run-in position, in which the tubular sliding shroud is disposed about the jumper tube and respective portions of the first and second completion joints, thereby covering the jumper tube;

wherein the assembly further comprises:

a locking mechanism connected to the first completion joint, the locking mechanism being operable to secure a first end portion of the tubular sliding shroud; and/or a retaining member connected to the second completion joint, the retaining member being operable to secure a second end portion of the tubular sliding shroud;

wherein the assembly comprises the retaining member connected to the second completion joint; and wherein the retaining member is adapted to at least partially secure the tubular sliding shroud in the run-in position.

17. The assembly of claim 16, wherein the retaining member secures the second end portion of the tubular sliding shroud to the second completion joint when the sliding shroud is in the run-in position, thereby obstructing longitudinal displacement of the tubular sliding shroud in at least one direction.

18. The assembly of claim 16, wherein respective portions of the base pipes and shunt tubes that are longitudinally disposed between the tubular outer shrouds of the first and second completion joints are covered by the tubular sliding shroud when the tubular sliding shroud is placed in the run-in position.

19. A method for making-up a connection between first and second completion joints, the method comprising:

providing the first and second completion joints, each of the first and second completion joints comprising:

a base pipe;

a shunt tube disposed along the base pipe; and a tubular outer shroud disposed about respective portions of the shunt tube and the base pipe;

coupling the shunt tube of the first completion joint to the shunt tube of the second completion joint with a jumper tube;

shifting a tubular sliding shroud from a first position to a second position; and locking the tubular sliding shroud in the second position;

wherein the tubular sliding shroud is disposed about at least one of the first and second completion joints in the first position;

wherein the tubular sliding shroud is disposed about the jumper tube and respective portions of the first and second completion joints in the second position;

wherein locking the tubular sliding shroud in the second position comprises:

securing a first end portion of the tubular sliding shroud with a locking mechanism; and/or securing a second end portion of the tubular sliding shroud with a retaining member:

and wherein locking the tubular sliding shroud in the second position comprises securing the second end portion of the tubular sliding shroud with the retaining member.

20. The method of claim 19, wherein the retaining member is connected to the second completion joint; and wherein securing the second end portion of the tubular sliding shroud with the retaining member comprises receiving the tubular sliding shroud within a portion of the retaining member as the tubular sliding shroud is displaced from the first position to the second position.

* * * * *